United States Patent [19]

Missman

[11] Patent Number: 4,542,927

[45] Date of Patent: Sep. 24, 1985

[54] FIREPLACE LOADING TOOL

[76] Inventor: Eugene E. Missman, 2300 N. 26th St., Boise, Id. 83702

[21] Appl. No.: 594,853

[22] Filed: Mar. 29, 1984

[51] Int. Cl.[4] ..... A47J 49/00

[52] U.S. Cl. ..... 294/9; 414/207

[58] Field of Search ..... 126/11, 222, 223, 68, 126/124; 110/101 R, 101 C, 101 CE, 289, 267; 294/9–14; 414/160, 172, 199, 207, 490, 452

[56] References Cited

U.S. PATENT DOCUMENTS

| | | | |
|---|---|---|---|
| 2,637,588 | 5/1953 | Burke | 294/9 X |
| 2,998,151 | 8/1961 | Sampson | 414/490 |
| 3,477,598 | 11/1969 | Hassell et al. | 414/452 |
| 4,186,839 | 2/1980 | Majors | 294/11 X |
| 4,248,464 | 2/1981 | Cress | 294/9 |
| 4,299,525 | 11/1981 | Coffman | 294/9 X |
| 4,354,702 | 10/1982 | Clements et al. | 294/9 |
| 4,392,479 | 7/1983 | Stair | 126/242 |
| 4,423,898 | 1/1984 | Spor | 294/9 |
| 4,453,876 | 6/1984 | Arpin | 414/207 X |
| 4,474,396 | 10/1984 | Dennie | 294/11 |

*Primary Examiner*—Margaret A. Focarino
*Attorney, Agent, or Firm*—Paul F. Horton

[57] ABSTRACT

A fireplace loading tool for loading logs or coal into a stove or fireplace including a pair of parallel, laterally spaced arm members and a lever arm downwardly depending from the arm members adjacent their effective longitudinal midpoint for pivoting the arm members to obtain a mechanical advantage in the loading of juel into a fireplace. The arms are preferably in the form of tines adapted to hold a log longitudinally placed thereon. Several floor supports are provided for use on fireplaces having varying characteristics. A coal tray with slide plate may be moveably mounted on the tines for the placement of coal into a fireplace.

11 Claims, 10 Drawing Figures

FIREPLACE LOADING TOOL

BACKGROUND OF THE INVENTION

1. Field of the Invention

This invention relates to devices for loading fossil fuels into a stove or fireplace.

2. Description of the Prior Art

Various tools have been devised for the placement of fossl fuels into fireplaces including the long-used shovels, forks, and stokers as well as log lifters typified by U.S. Pat. Nos. 4,240,656 issued to J. M. Feighery, 4,248,464 issued to E. F. Cross, and 4,423,898 issued to H. Spor; scoops, as typified by U.S. Pat. No. 4,194,778 issued to C. L. Hodnett; door loaders as shown by U.S. Pat. No. 4,131,104 issued to J. R. Choate; and the lug loader shown by U.S. Pat. No. 4,299,525 issued to R. G. Coffman. Primary considerations in the use of such tools are safety and convenience of loading the fireplace with fuel. Fireplace loading tools presently in the art are for the most part not usable by the elderly and infirm in that the strength required for lifting and pitching the fuel is lacking. None of the existing loading tools are adapted to rest upon a floor, hearth, or sill and yet provide a distinct mechanical advantage for ease of unloading.

SUMMARY OF THE INVENTION

The present invention is an improvement over the prior art in its ease of use and its adaptability to stoves and fireplaces of varying characteristics as well as its versatility as to type of fossil fuel employed.

The present invention includes, in general, a fireplace loading tool provided with a pair of tines adapted to hold a log placed lengthwise thereon; a lever arm connected to the tines adjacent their longitudinal midpoint; and a combination handlelogstop which prevents rearward slippage of a log placed upon the tines and which is used to pivot the tool at the point where the lever arm engages the hearth, floor, or fireplace sill. Varying floor support members are used depending upon the characteristics of the fireplace and hearth. A more comprehensive description of the tool may be found in the appended claims.

It is therefore an important object of the present invention to provide a fireplace loading tool having a lever arm engaging the fuel supporting structure adjacent its longitudinal midpoint and which is adapted to rest on a floor, hearth, or fireplace sill, for providing considerable mechanical advantage in the unloading of a fuel into a fireplace.

An additional object of the present invention is to provide a fireplace loading tool which is readily adaptable to fireplaces having openings of varying heights and hearths of varying heights relative to the floor.

Another object of the present invention is to provide a fireplace loading tool which is adapted to hold a log in its longitudinal position, which may hold logs placed crosswise thereon, and which may be used for the loading of coal into a fireplace.

Another object of the present invention is to provide a fireplace loading tool with log supporting tines and which is provided with a lever arm adjacent the longitudinal midpoint of the tines so that the free end of the tines extends deeply into a fireplace opening for unloading of the log well within the fireplace without throwing the log and with a distinct mechanical advantage. These and additional objects and advantages will be come apparent and a more thorough and comprehensive understanding may be had from the following description taken in conjunction with accompanying drawings forming a part of the specification.

DETAILED DESCRIPTION OF THE INVENTION

Figure 1:
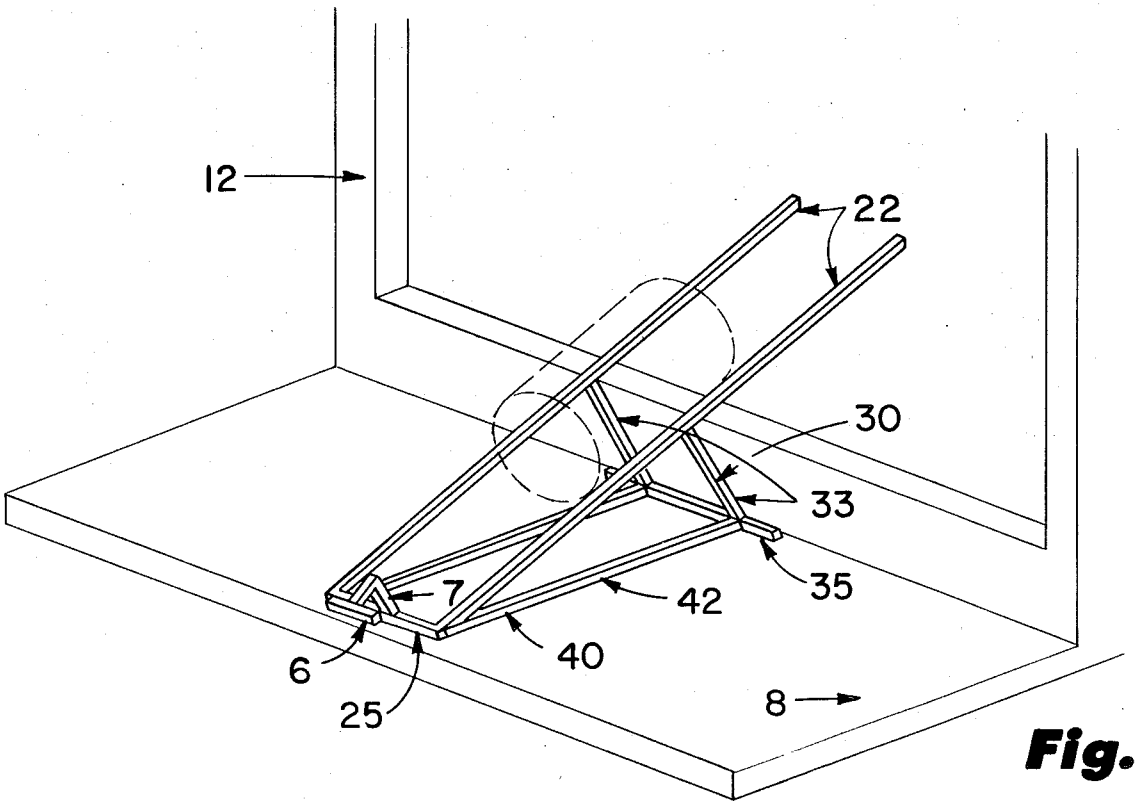
FIG. 1 is a rear top perspective view of the fireplace loading tool of the present invention shown supporting a log for unloading.
Figure 2:
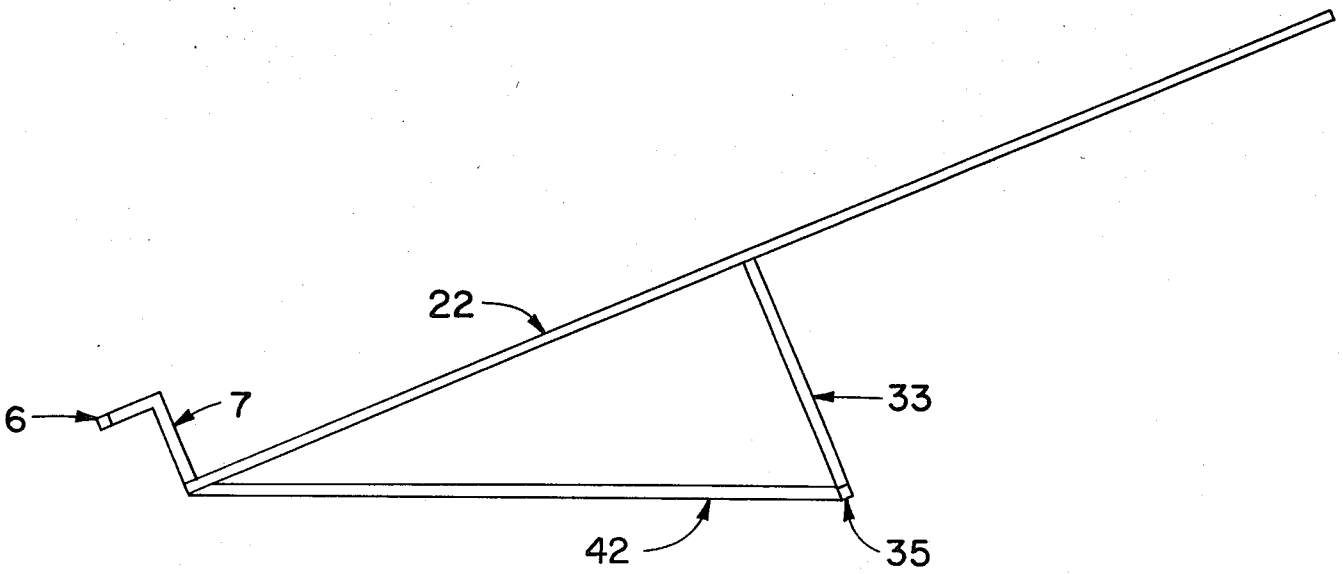
FIG. 2 is a side elevation of the tool of FIG. 1.

Referring now to FIGS. 1 and 2, one preferred embodiment of a fireplace loading tool, made according to the present invention is disclosed. The tool includes a pair of laterally spaced arm members 22, particularly adapted to hold a log 3 placed lengthwise thereon, and a lever arm 30 depending from the arm member, the bottom of the lever arm serving as a fulcrum for pivoting the tool to gain a mechanical advantage, i.e. leverage, for the unloading of the log into a fireplace. The term "fireplace" as used herein and in the claims is broadly defined, including stoves.

Arm members 22 are preferably constituted of tubular steel and are in the form of tines connected by one or more cross members 25. Longitudinally extending tines 22 are parallel spaced at a distance suitable to hold a log as shown in FIG. 1. It is obvious that while being adapted to support such a log in a longitudinal position, logs may be placed crosswise on the tines for delivery to a fireplace 12. A log stop 7 upwardly extending from cross member 25 is operable to contact the rear surface of the log to hold the log in place. Stop 7 is provided with a rearwardly extending handle 6 which is used to pivot the tool.

The lever arm, designated generally by the numeral 30 and preferably in the form of a pair of parallel tubular rods 33, downwardly depends from arm members 22 substantially adjacent the longitudinal midpoint of the arms. The function of the lever arm is to obtain a desired, preselected, mechanical advantage for the dumping of the fuel and therefore the placement of the lever arm relative to the support arms together with the length and angle of inclination of the lever arm determines such mechanical advantage. It is therefore the effective midpoint which is of most importance. The lever arm in the preferred embodiments is provided with a pivot bar 35 also constructed of hollow tubular steel.

Floor support means, designated generally by the numeral 40, include a pair of steel tubes 42, in the instant embodiment, which are affixed to and extend rearwardly from the lever arm 33 or pivot bar 35. The floor support means rest upon a support surface such as flooring or a hearth 8 to hold the arm members 22 at a selected upward inclination for loading.

Figure 5:
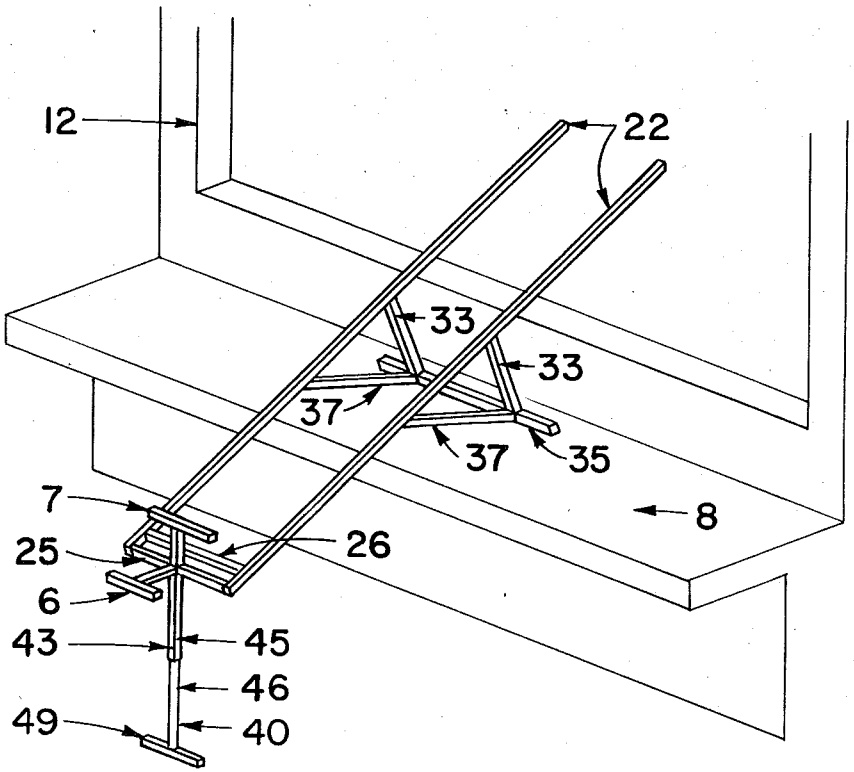
FIG. 5 is a rear top perspective view showing the tool utilizing a telescoping leg for floor support.
Figure 6:
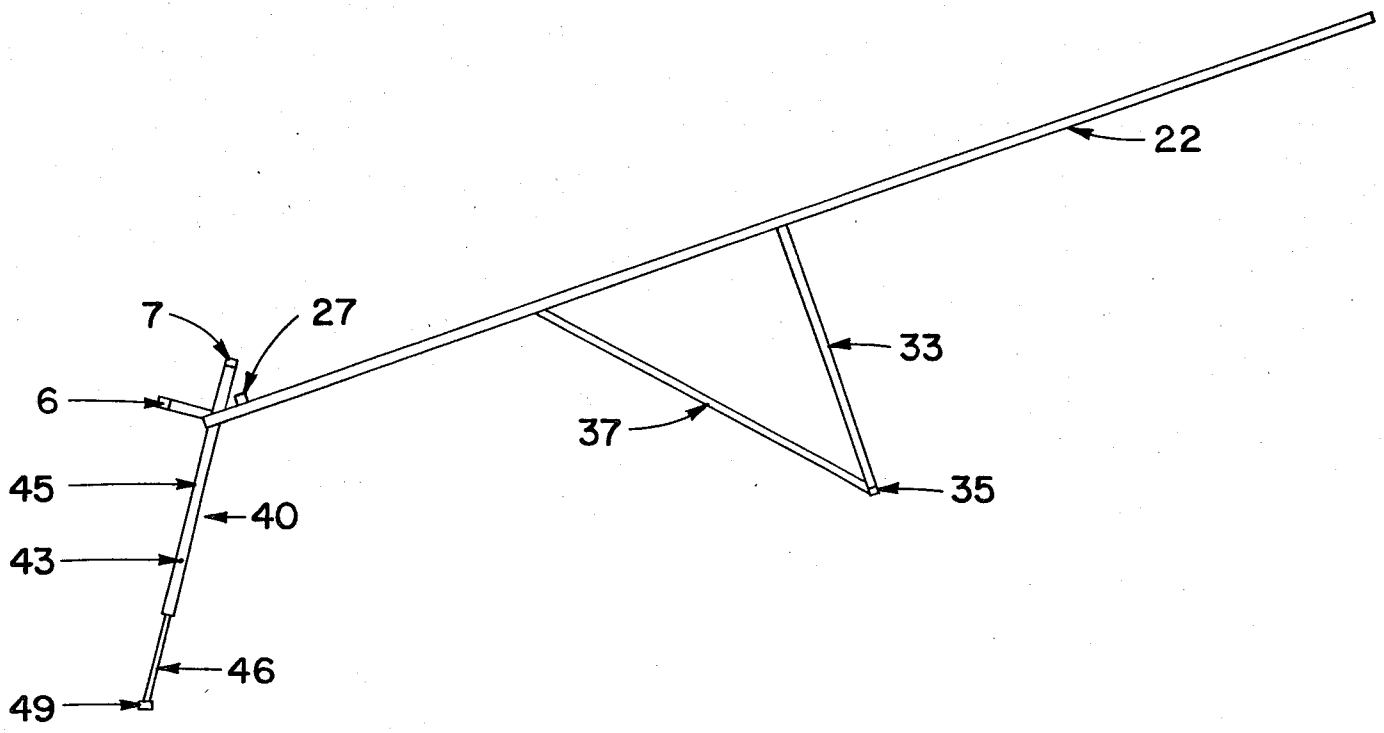
FIG. 6 is a side elevation of the tool of FIG. 5.

Referring now to FIGS. 5 and 6, another type of floor support means 40 is shown to advantage. The floor support means shown in FIGS. 5 and 6 is used where the hearth is of insufficient width to properly support the tool. This support includes a first tubular leg 45 pivotally engaging cross member 25 and a second leg 46 telescopically engaging leg 45. Latch means in the form of retention pin 43, adapted to extend through one or more apertures vertically spaced on the legs, is used to hold the arm members at a selected height. In this embodiment it is desirable to omit steel tubes 42 and to provide a pair of auxiliary braces 37 extending between the lever arms 33 and the arm members 22, for additional support. It is also desirable to provide a second cross member 26, immediately forward of cross member 25, provided with a pivot stop 27 to restrict the forward pivoting motion of the legs. Logstop 7 may be attached to the top of first leg 45 for convenience in construction. The lower leg, second leg 46, may be provided with a foot pad 49 for weight distribution.

Figure 3:
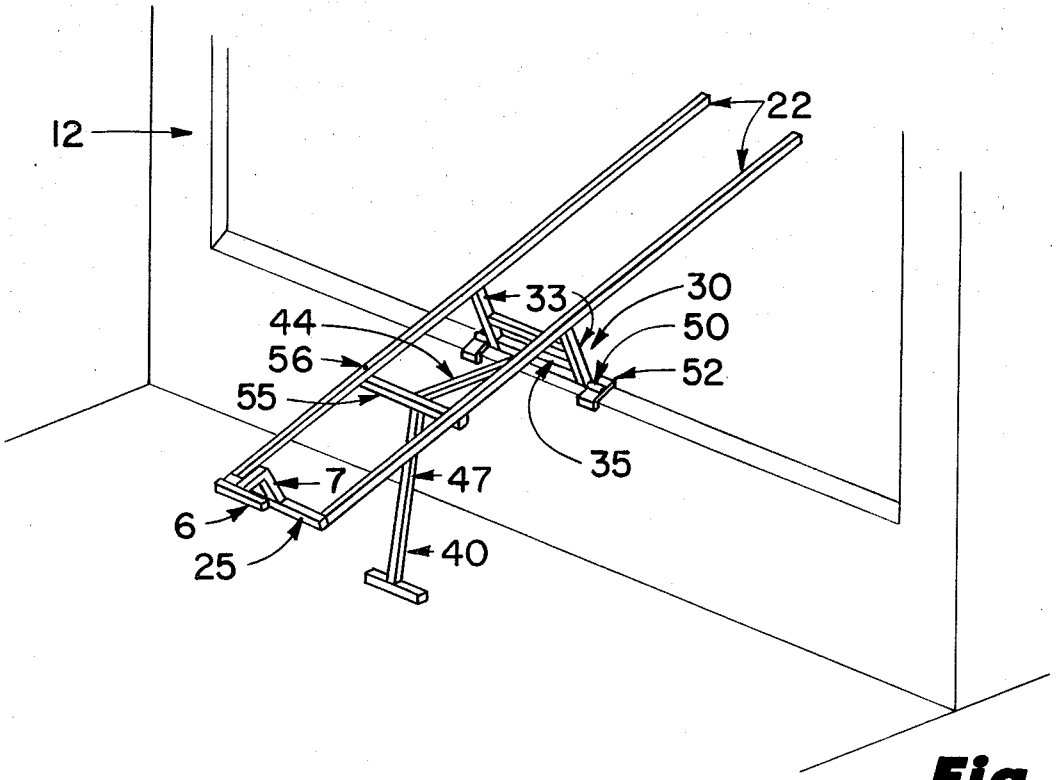
FIG. 3 is a rear top perspective view showing the tool with a foot brace for support.
Figure 4:
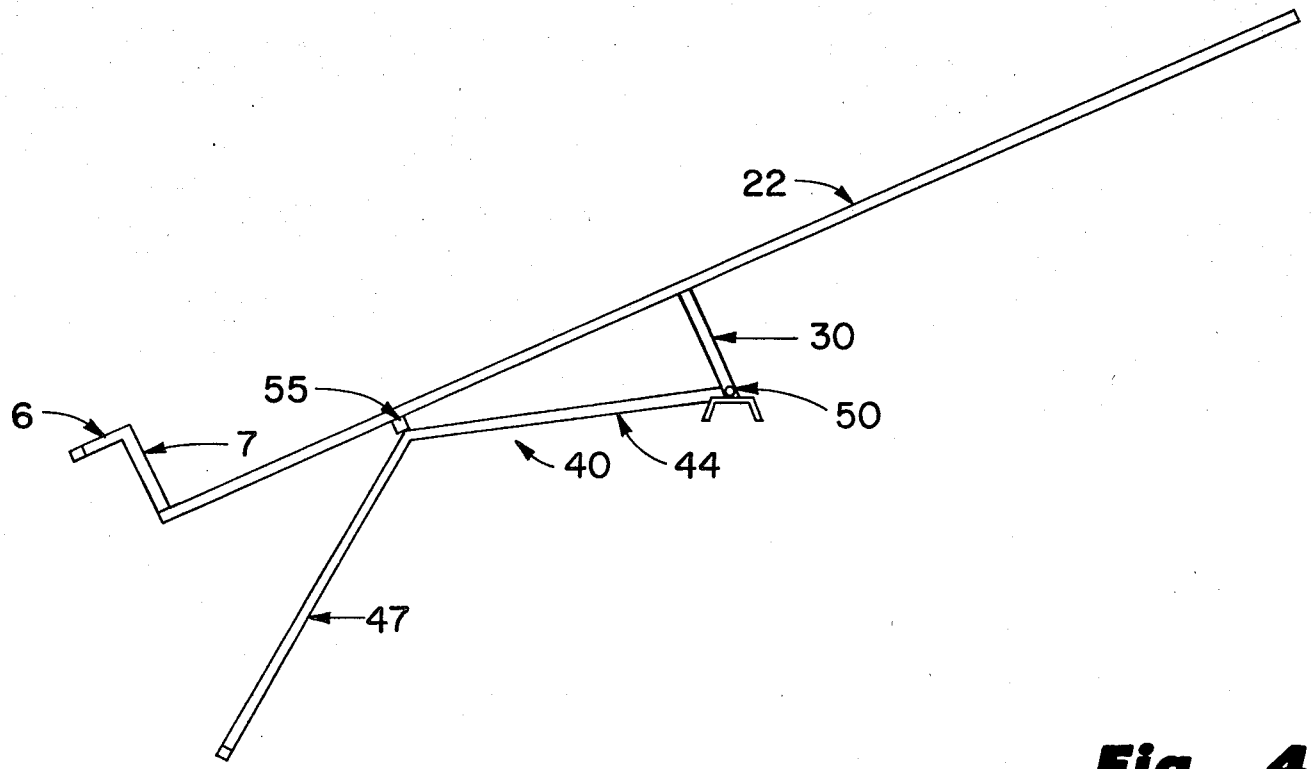
FIG. 4 is a side elevation of the tool of FIG. 1.

Referring now to FIGS. 3 and 4, yet another embodiment of floor support means 40 may be seen. This embodiment of the floor support means may be used where a hearth is lacking or where it is desirable that the tool pivot upon the lip or sill of a fireplace. The floor support means of this embodiment includes a foot brace comprised of a pair of leg members 44 and 47 set at an angle one to the other with leg 44 pivotally engaging arm lever 30. For purposes of construction a pivot bolt 50 may be inserted through a divided hollow tubular pivot bar 35 connected to lever arms 33. Leg 44 of the foot brace is connected to the pivot bolt 50 and a pair of sill engaging members 52, substantially inverted U-shaped in form are connected to the ends of the pivot bolt so that the log supporting tines 22 may be pivoted without movement of the sill engaging members 52.

A leg stop 55 may be pivotally mounted by pin 56 to tines 22 to engage the apex of the joinder of legs 44 and 47 to hold the foot brace in position. Pivoting leg stop 55 to the side allows the foot brace to pivot upwardly between the tines for compactness for storage or portability purposes. A footpad may be affixed to the bottom end of leg 47 for weight distribution upon the supporting surface.

Figure 7:
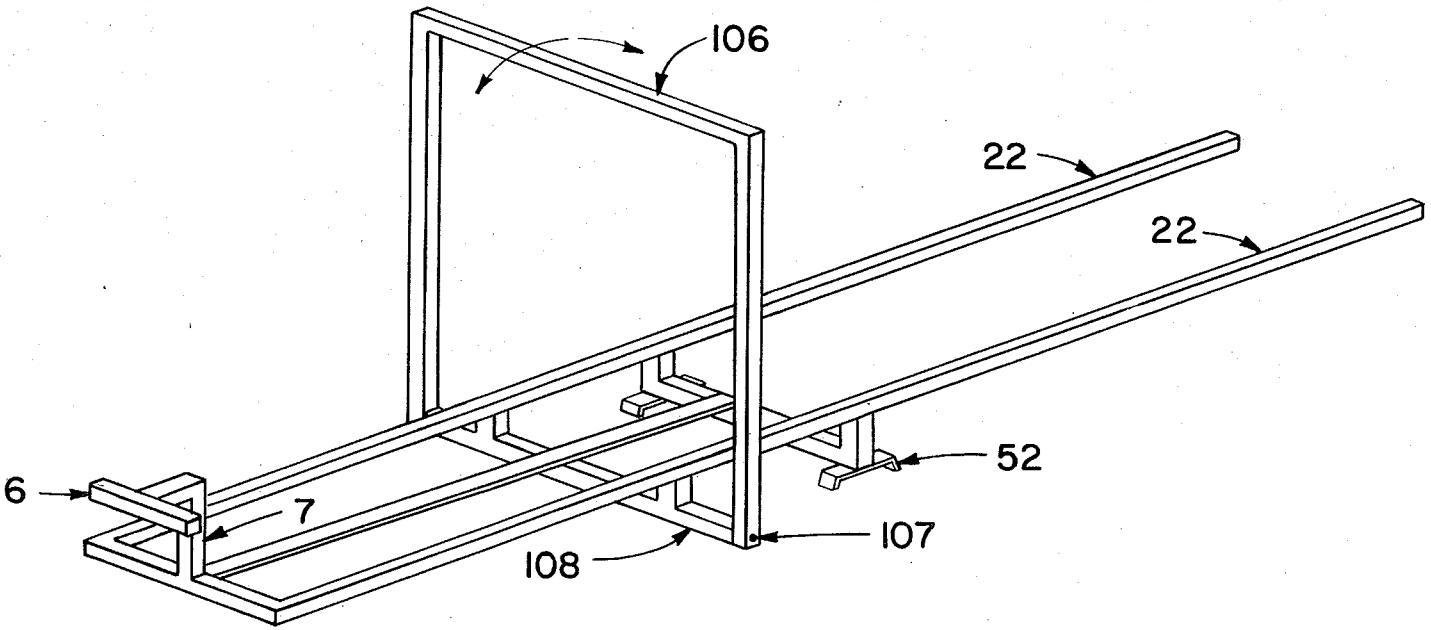
FIG. 7 is a perspective view of the tool shown with a second handle for lifting purposes.

As shown to advantage in FIG. 7, for use under conditions where a floor support is not needed or not useable, a second handle 106 pivotally engages a hinge pin 107 extending through a sleeve 108 welded to arm members 22. A log, not shown, extending through the opening defined by handle 106 and against log stop 9 may be lifted by use of handles 6 and 106 to a position where sill engagement members 32 rest upon the sill of a stove with the free end portions of arm members 22 extending well into the firepot of the stove. By raising the round of the loading tool with the sill engagement members pivoting on the stove sill, a log may be slipped into the stove without fear of burns.

Figure 10:
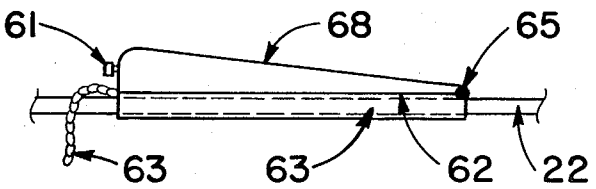
FIG. 10 is a side elevation of the coal dumping assembly.
Figure 9:
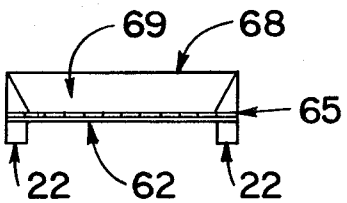
FIG. 9 is a front elevation of the coal dumping assembly.
Figure 8:
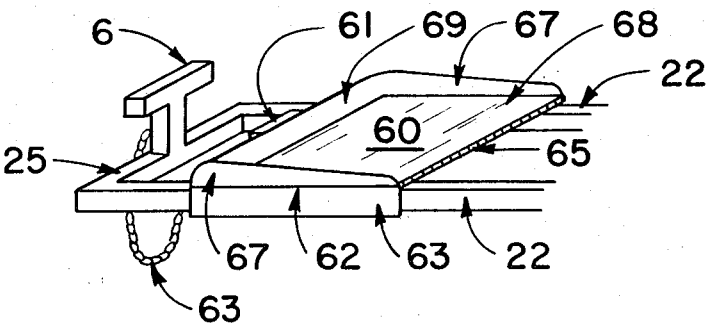
FIG. 8 is a perspective view of the coal dumping assembly slidably mounted on the tines of the tool.

For use of coal rather than logs for fuel, a coal dumping assembly 60 is provided as shown to advantage in FIGS. 8–10. Assembly 60 includes a slide member, preferably in the form of a plate 62. Plate 62 is provided with a pair of side members 63 to engage arm members 22 for holding the plate to the arm members during the sliding process. Connected to slide plate 62 at its forwardmost end by hinge 65 is coal tray 68. The coal tray is provided with a pair of side walls 67 and a rear end wall 69 to contain the coal. Assembly retention means are used to restrict the forward motion of the slide plate with attached tray. A small chain 63 affixed to the rear of the slide plate and attachable to log stop 7 is satisfactory. A handle 61 is used to pivot tray 68 about hinge 65 for dumping the coal into the fireplace.

For operation of the device to load a log into the fireplace, a log is first placed preferably lengthwise on arm members 22. Handle 6 is then used to pivot the log supported by the arms. It will be seen that because of the substantially effective centering of the lever arm 30 on the arm members that a great mechanical advantage may be had in pivoting the log and therefore the pivoting of the log is accomplished with comparative ease. If it is desired that coal be used as a fuel, then assembly 60 is simply mounted onto the arm members 22 with the slide plate 62 engaging the arms. As handle 6 is raised, the assembly slides forward and handle 62 of tray 68 is raised to dump the coal. Chain 63 restricts the forward movement of the assembly to a selected position. The particular type of floor support means 40 employed will depend upon the characteristics of the fireplaces, hearth, and supporting surfaces available, as shown in the Figures.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claim are therefore to be embraced therein.

I claim:

1. A fireplace loading tool comprising:

a pair of longitudinally extending, laterally and parallel spaced tines affixed to one another by at least one cross member for supporting a log longitudinally placed thereon;

a lever arm downwardly depending from said tines adjacent the longitudinal midpoint of said tines for pivotally engaging a support surface for obtaining mechanical advantage in the unloading of fossil fuel into a fireplace;

floor support means in engagement with said tines for holding said tines at a selected upward inclination for loading;

a log stop upwardly extending and affixed to said tines for engaging the rear surface of a log supported by said tines; and a handle connected to the rearmost portion of said tines for pivoting said lever arm for unloading fossil fuel supported by said tines.

2. The apparatus as described in claim 1 wherein said floor support means includes one or more support rods connected between said tines and said lever arm for resting upon a support surface.

3. The apparatus as described in claim 1 wherein said floor support means includes a first leg member connected to said tines and a second leg member telescopically engaging said first leg member and latch means operable to hold said leg member in a selected extended relationship with one another for holding the rearward portion of said tines a desired height above a supporting surface.

4. The apparatus as described in claim 1 further comprising a coal dumping assembly, said assembly including a slide member operable to slidingly engage each of said tines; a coal tray hingably engaging said slide member adjacent the forwardmost end of the slide member; and assembly retention means operable to restrict the forward movement of said slide member.

5. A fireplace loading tool comprising:

a pair of longitudinally extending, laterally and parallel spaced arm members affixed to one another by at least one cross member for supporting a log longitudinally placed thereon;

a lever arm downwardly depending from said arm members adjacent the longitudinal midpoint of said arm members for pivotally engaging a support surface for obtaining mechanical advantage in the unloading of fossil fuel into a fireplace;

floor support means including a foot brace hingably engaging said lever arm, said foot brace including a fireplace sill engaging means for the pivoting of said lever arm and attached supporting arm members thereon and further including a leg member with foot pad; and a foot brace retainer memeber supported by said arm members for engaging the leg of said foot brace for holding the foot brace at a preselected position to support the rearward portion of said arm members a selected height above a support surface.

6. The apparatus as described in claim 5 further comprising a log stop upwardly depending from said arm members for engaging the rear surface of a log supported by said arm members.

7. The apparatus as described in claim 5 further comprising a handle connected to the rearwardmost portion of said arm members for pivoting said lever arm for unloading fossil fuel supported by said tines.

8. The apparatus as described in claim 5 further comprising a coal dumping assembly, said assembly including a slide member operable to slidingly engage said arm members; a coal tray hingably engaging said slide member adjacent the forwardmost end of said slide member; and assembly retention means operable to restrict the forward movement of said slide member.

9. A fireplace loading tool comprising:

a pair of longitudinally extending arm members laterally spaced and affixed to one another by at least one cross member, for supporting a log longitudinally placed thereon; and a lever arm downwardly depending from said arm members adjacent the longitudinal midpoint of said arm members,. for pivotally engaging a support surface for obtaining mechanical advantage in the unloading of a fossil fuel into a fireplace; and floor support means including one or more braces affixed to and backwardly extending from said lever arm for engaging a support surface to hold said arm members at a selected upward inclination for loading.

10. A fireplace loading tool comprising:

a pair of longitudinally extending arm members laterally spaced and affixed to one another by at least one cross member, for supporting a log longitudinally placed thereon; and a lever arm downwardly depending from said arm members adjacent the longitudinal midpoint of said arm members, for engaging a support surface for obtaining mechanical advantage in the unloading of a fossil fuel into a fireplace; and floor support means including a foot brace hingably engaging said lever arm, said foot brace including fireplace sill engaging means for pivoting said log supporting arm members thereon and said foot brace operable to be set in a preselected position to support the rearward portion of said arm members a selected height above a support surface.

11. A fireplace loading tool comprising:

a pair of longitudinally extending arm members laterally spaced and affixed to one another by at least one cross member, for supporting a log longitudinally placed thereon; and a lever arm downwardly depending from said arm members adjacent the longitudinal midpoint of said arm members, for pivotally engaging a support surface for obtaining mechanical advantage in the unloading of a fossil fuel into a fireplace; and a coal dumping assembly, said assembly including a slide plate operable to slidingly engage each of said arm members; a coal tray hingably engaging said slide plate adjacent the forwardmost end of said slide plate; and assembly retention means operable to restrict the forward movement of said slide plate.

* * * * *